US011678752B2

(12) United States Patent
Baumel et al.

(10) Patent No.: US 11,678,752 B2
(45) Date of Patent: Jun. 20, 2023

(54) PILLOW SYSTEM

(71) Applicant: Sleep Again Pillows LLC, Denver, CO (US)

(72) Inventors: Rachel Baumel, Denver, CO (US); Mitsue Yamamoto, Denver, CO (US)

(73) Assignee: SLEEP AGAIN PILLOWS LLC, Denver, CO (US)

( * ) Notice: Subject to any disclaimer, the term of this patent is extended or adjusted under 35 U.S.C. 154(b) by 211 days.

(21) Appl. No.: 17/244,335

(22) Filed: Apr. 29, 2021

(65) Prior Publication Data

US 2022/0007864 A1 Jan. 13, 2022

Related U.S. Application Data

(60) Provisional application No. 63/049,808, filed on Jul. 9, 2020.

(51) Int. Cl.
*A47G 9/10* (2006.01)
*A47C 20/02* (2006.01)

(52) U.S. Cl.
CPC ..... *A47G 9/1072* (2013.01); *A47C 20/025* (2013.01)

(58) Field of Classification Search
CPC ..... A47C 20/025; A47C 20/026
See application file for complete search history.

(56) References Cited

U.S. PATENT DOCUMENTS 2,795,802 A * 6/1957 Myers ..... A47G 9/10 5/636
3,003,815 A * 10/1961 Zinn ..... A47C 3/16 297/DIG. 2
4,173,048 A * 11/1979 Varaney ..... A47C 20/023 5/640
5,012,539 A 5/1991 Grigg
5,016,303 A 5/1991 Tanaka et al.
5,697,112 A * 12/1997 Colavito ..... A47C 27/085 5/655.5
5,978,990 A * 11/1999 Akey ..... A47C 20/021 5/632
6,412,127 B1 * 7/2002 Cuddy ..... A47C 20/026 5/640
6,760,934 B1 * 7/2004 Leach ..... A47C 20/021 5/632
7,089,614 B1 * 8/2006 Clapp ..... A47C 20/025 5/652
7,426,762 B2 9/2008 Dazzi
(Continued)

FOREIGN PATENT DOCUMENTS

CN 205054698 U 3/2016

*Primary Examiner* — Eric J Kurilla
(74) *Attorney, Agent, or Firm* — Holzer Patel Drennan

(57) ABSTRACT

A pillow system for use by a user laying on their back, such as for use after a mastectomy or other surgery. The pillow system provides a cushioning and supportive system. In one particular implementation, the pillow system has two elongate side pillows for placing under and extending from at least a user's shoulders to the user's knees. The two side pillows have an inner edge that includes two concave regions, thus when the two pillows are placed next to or alongside each other, two generally void areas are formed. The pillow system may include a head pillow and/or a support pillow(s), such as a wedge-shaped pillow.

16 Claims, 14 Drawing Sheets

(56) References Cited

U.S. PATENT DOCUMENTS

| | | | | |
|---|---|---|---|---|
| 7,540,050 | B1 * | 6/2009 | Nazer | A47C 20/025 5/632 |
| 7,886,381 | B2 * | 2/2011 | Aiken | A47C 20/025 5/636 |
| 8,074,310 | B1 * | 12/2011 | Robbins | A47C 20/025 5/632 |
| 8,419,128 | B1 * | 4/2013 | Leach | B60N 2/2881 5/655 |
| 8,572,780 | B1 * | 11/2013 | Watters | A47G 9/1054 5/636 |
| 8,671,480 | B1 * | 3/2014 | Leach | A47D 13/083 5/655 |
| 9,326,906 | B2 | 5/2016 | Thanas | |
| 10,806,278 | B1 * | 10/2020 | Leach | A47C 20/025 |
| 10,827,843 | B2 * | 11/2020 | Miller | A47C 20/025 |
| D906,013 | S | 12/2020 | Chunyu | |
| D908,392 | S | 1/2021 | Despen | |
| 10,898,007 | B1 * | 1/2021 | Rozon | A47C 20/025 |
| 11,051,629 | B1 * | 7/2021 | Leach | A47C 20/021 |
| 11,141,010 | B1 * | 10/2021 | Mitchell | A47C 20/027 |
| 2005/0278864 | A1 * | 12/2005 | Leach | A47C 20/023 5/732 |
| 2006/0021146 | A1 * | 2/2006 | Tokarz | A47C 27/081 5/632 |
| 2010/0263127 | A1 * | 10/2010 | Jamshidi | A47C 20/025 29/428 |
| 2011/0107522 | A1 * | 5/2011 | Muollo | A47C 27/10 5/710 |
| 2019/0069686 | A1 * | 3/2019 | Miller | A47G 9/1036 |
| 2019/0320806 | A1 * | 10/2019 | Hansen | A47C 20/021 |
| 2021/0177681 | A1 * | 6/2021 | Davis | A47C 20/026 |

* cited by examiner

PILLOW SYSTEM

CROSS-REFERENCE

This application claims priority to U.S. provisional patent application 63/049,808 filed Jul. 9, 2020 and titled PILLOW SYSTEM, the entire disclosure of which is incorporated herein by reference for all purposes.

BACKGROUND

Breast cancer is the most common cancer in women. The combination of radiation, chemotherapy and surgery is the main treatment for breast cancer. Depending on the extent (size) of the cancerous tumor, and also taking into account the patient's desires, anywhere from a small lump may be removed from the breast, all the way to the entire breast being removed (a mastectomy). A mastectomy is drastic; it may damage the pectoralis major, pectoralis minor muscle and nerves, blood vessels, lymphatic vessels, hence causing blood and lymph reflux disorder reflux disorder that can lead to upper extremity edema, dysfunction, skin flap necrosis and other complications, etc. A mastectomy definitely affects patient comfort, satisfaction and quality of life.

Various attempts have been made to comfort and ease the pain of mastectomy and other patients after surgery. One method is to use a pillow to hold up the patient's arm on the surgery side while the patient is laying on their back and avoid turning, which is the preferred position for healing.

Laying on one's back is the preferred position for many post-surgery and other medical situations, not just after a mastectomy. For many people, laying on the back is the preferred personal preference.

SUMMARY

The present disclosure is directed to a pillow system particularly configured for a user laying, sleeping, or otherwise arranged supported on their back; the pillow system can be used for sleeping or merely relaxing. The pillow system is formed by at least two discrete side-support pillows that are a cushioning and supportive system for the entire body of the user when sleeping or otherwise laying on their back, and can include various support pillow(s).

This disclosure provides a pillow system that has at least two symmetrical, elongate side pillows for placing under and extending from at least a user's shoulders to the user's knees. The two pillows have an inside edge that includes two concave regions, thus when the two pillows are placed next to or alongside each other, two void areas, which can have a generally circular shape, are formed between the two pillows. In one implementation, the pillow system includes the two side pillows, a head pillow, and a support pillow (e.g., a wedge-shaped pillow). In some implementations, the pillow system includes two (e.g., wedge-shaped) support pillows.

Together, the discrete and individual pillows create a pillow system that cradles, hugs, and supports the user when the user is laying on their back on the pillow system.

DETAILED DESCRIPTION

Figure 1:
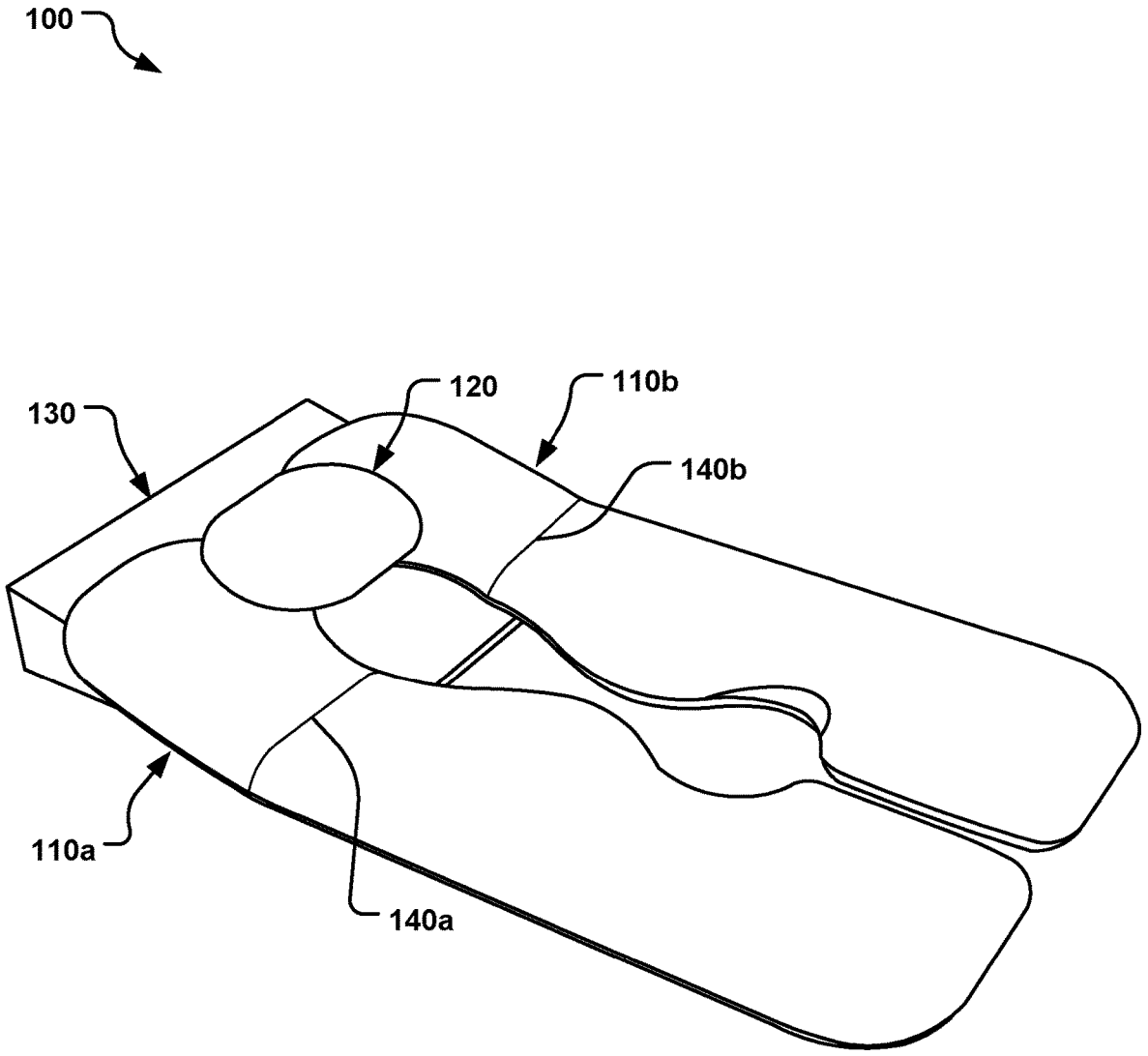
FIG. 1 is a perspective view of a pillow system.

As indicated above, the present disclosure is directed to a pillow system formed by multiple pillows, the system, particularly adapted for use by a patient after a mastectomy or other surgery. After a mastectomy or other surgeries, for most patients, it is no longer possible to sleep on their side or stomach; rather, sleeping on their back is the only way to sleep. The pillow system provides a cushioning and supportive system for a patient when sleeping or otherwise laying on their back.

In the following description, reference is made to the accompanying drawing that forms a part hereof and in which is shown by way of illustration at least one specific implementation. The following description provides additional specific implementations. It is to be understood that other implementations are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples, including the figures, provided below. In some instances, a reference numeral may have an associated sub-label consisting of a lower-case letter to denote one of multiple similar components. When reference is made to a reference numeral without specification of a sub-label, the reference is intended to refer to all such multiple similar components.

FIG. 1 shows one particular implementation of a pillow system 100, having two symmetrical, elongate side pillows 110*a*, 110*b* that provide the majority of the support of the system 100. These two elongate side pillows 110 are positioned under the user's back, hip and buttocks when the user is laying on the system 100, the side pillows 110 extending from at least the user's shoulders to past (below) the butt, often to the user's knees. The pillow system 100 also includes a small pillow 120 for supporting the user's head or neck, and at least one support pillow 130 (e.g., a wedge) for altering the incline of one or more of the user's head, upper body, knees, or feet. It is understood that one or more of the side pillows, the head pillow or the support pillow(s) may have different features and details than described below while remaining within the overall guise of a pillow system according to this disclosure.

Figure 2:
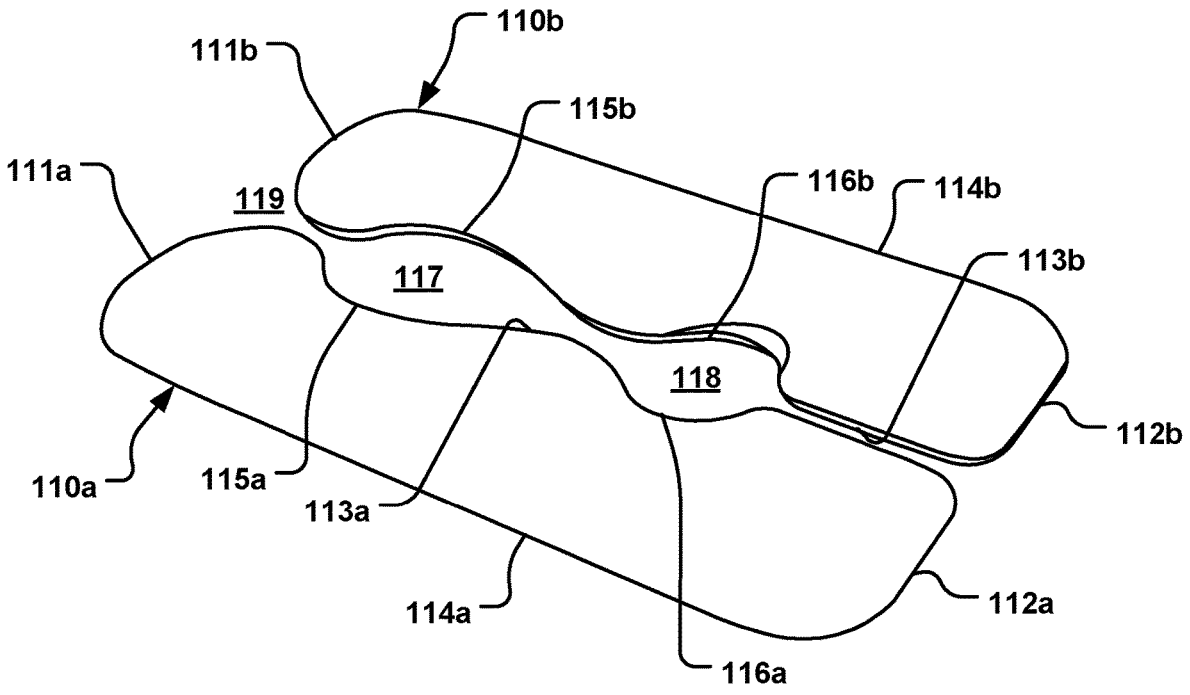
FIG. 2 is a perspective view of two elongate side pillows of the pillow system of FIG. 1.

FIG. 2 shows the two elongate side pillows 110, specifically, pillows 110*a* and 110*b*. The side pillows 110 have a profile that is designed to provide support to the user at specific locations and to reduce or remove pressure points at other locations. The two side pillows 110 are mirror images. Each side pillow 110*a*, 110*b* has a first end 111*a*, 111*b* and an opposite second end 112*a*, 112*b*, a first edge 113*a*, 113*b* that includes two concave regions, and a second edge 114*a*, 114*b*. When arranged as shown in the figure or in FIG. 1, with the two pillows 110 next to or alongside each other, the first end 111 is proximate the user's head (when used properly by the user), the second end 112 is toward the user's feet, and the first edge 113 is an inner edge closest to the other side pillow 110, and the second edge 114 is an outer edge farthest from the other side pillow 110. Each of the corners or transitions between the ends 111, 112 and the edges 113, 114 is rounded or radiused.

It is noted that some users may prefer to flip or change the orientation of the pillows 110, so that the second end 112 is proximate the user's head and the first end 111 is toward the user's feet, with the first edge 113 still an inner edge closest to the other side pillow 110, and the second edge 114 still an outer edge farthest from the other side pillow 110. Use of the pillows 110 in this manner is completely acceptable and may be more comfortable for certain users.

The inner edge 113*a*, 113*b* has a first concave region 115*a*, 115*b* proximate the first end 111 and a second concave region 116*a*, 116*b* closer to the second end 112*a*, 112*b*. The concave regions 115, 116 are arcuate, a part of which is formed by one or more radius.

When the two side pillows 110 are positioned for their "in use" position as in FIG. 1 and in FIG. 2, two void areas 117, 118 are formed between the pillows 110 by the concave regions 115, 116. The two concave regions 115, 116 in the inner edge 113 are not the same (e.g., in depth, width, arcuate shape) so that the resulting void areas 117, 118 are not the same in size or shape. In this particular implementation, each of the two concave regions 115, 116 is not symmetrical across an axis that extends orthogonal to the length of the pillows (e.g., across from one pillow 110*a* to the other pillow 110*b*).

The two void areas 117, 118 may be, e.g., perfectly circular, generally circular, or oval, or may be some other shape that has edges that are defined by at least one radius. For example, as seen in FIG. 2, the void area 117 formed by the first concave region 115 is an elongate, football shape, whereas the void area 118 formed by the second concave region 116 is tear-drop shaped. Neither void area 117, 118 is symmetrical across an axis that extends orthogonal to the length of the pillows (e.g., across from one pillow 110*a* to the other pillow 110*b*), although in other implementations, may be.

When in use, the user's tailbone is generally proximate the second void area 118 and the first void area 117 is generally located in the area proximate the user's shoulder blades and lower neck and back.

In this particular implementation of the pillows 110, the inner edge 113 is radiused from the first end 111 to the concave region 115, whereas the edge 113 has a straight portion extending between the second end 112 and the concave region 116. The entire outer edge 114 is straight, other than the radiused portions at the corners with the ends 111, 112. Because of the radiused transition from the first end 111 to the inner edge 113, another void area 119, shown generally shaped as a "v" but could have other shapes, is present when the pillows 110 are positioned "in use."

The thickness of the side pillows 110 may not be constant from the inner edge 113 to the outer edge 114 and from the first end 111 to the second end 112, but rather, the peripheral edges can be tapered, providing a thinner thickness at the edges than at the center of the pillows. In some implementations, the thickness of the side pillows 110 is constant from the first end 111 to the second end 112, or in other words, the top and bottom surfaces of the pillows 110 are parallel and the distance between them is constant, other than any taper at the edges. In the shown implementations, both surfaces (top and bottom) of the pillows 110 taper to meet at a center point of the pillow thickness at the ends 111, 112 and edges 113, 114. In other implementations, any or all of the edges of the ends 111, 112 and edges 113, 114 may have a portion that is orthogonal to, or at a right angle to, the top and bottom surfaces of the pillows 110. In other implementations, the thickness of the side pillows 110 may vary longitudinally from or between the first end 111 to the second end 112 and/or laterally from or between the inner edge 113 to the outer edge 114. For example, the inner edge 113 proximate one or both of the concave regions 115, 116 may be thicker than the outer edge 114.

Figure 3:
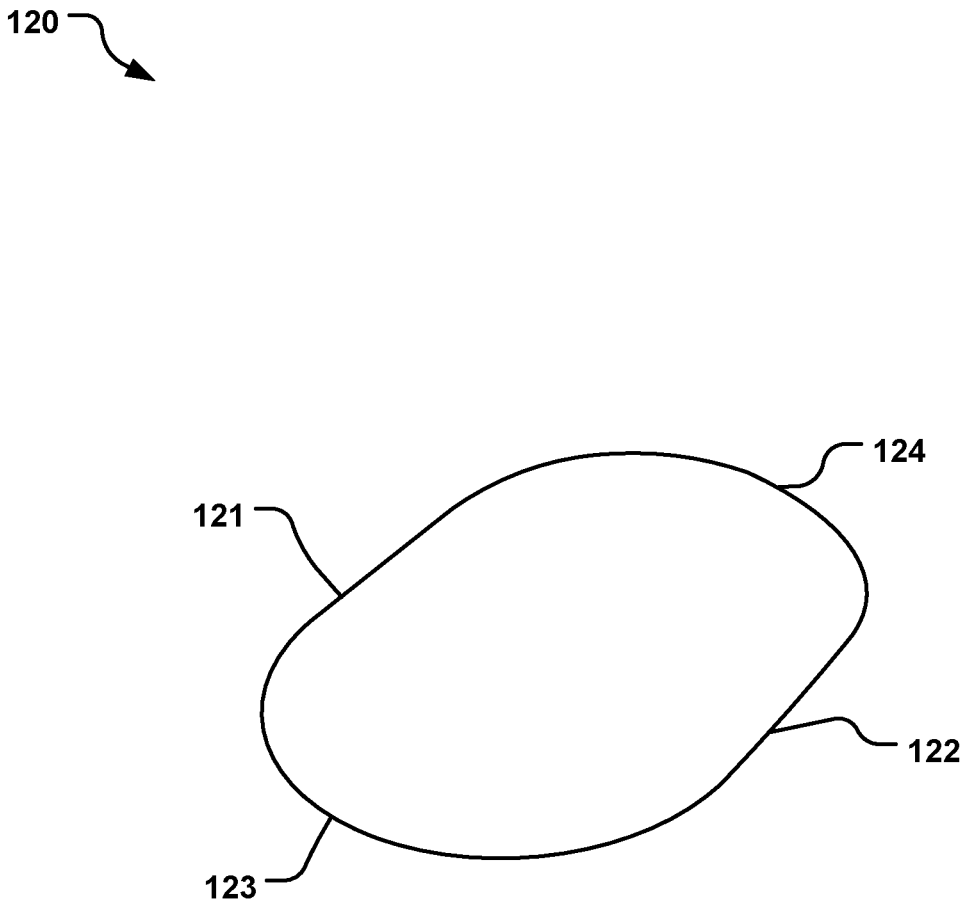
FIG. 3 is a perspective view of a head support pillow of the pillow system of FIG. 1.

FIG. 3 shows the small pillow 120, which is configured to be used to support the user's head or neck. The head support pillow 120 has a first edge 121, a second opposite edge 122, a first end 123 and a second opposite end 124. Although the pillow 120 is shown as generally rectangular with radiused (e.g., curved) ends 123, 124, the pillow may be, e.g., oval, circular, square, arcuate, or any other suitable shape.

As with the side pillows 110, the thickness of the head pillow 120 is not constant from the first edge 121 to the second edge 122 and from the first end 123 to the second end 124, but rather, the peripheral edges are tapered, providing a thinner thickness at the edges than at the center of the pillow 120. In the shown implementation, both surfaces (top and bottom) of the pillow 120 taper to meet at a center point of the pillow thickness at the edges 121, 122 and the ends 123, 124. In other implementations, any or all of the outermost portion of the edges 121, 122 and ends 123, 124 may have a portion that is orthogonal to, or at a right angle to, the top and bottom surfaces of the pillow 120. Additionally or alternately, the pillow 120 may have a concave top surface, e.g., to cradle the user's head and/or neck.

Figure 4:
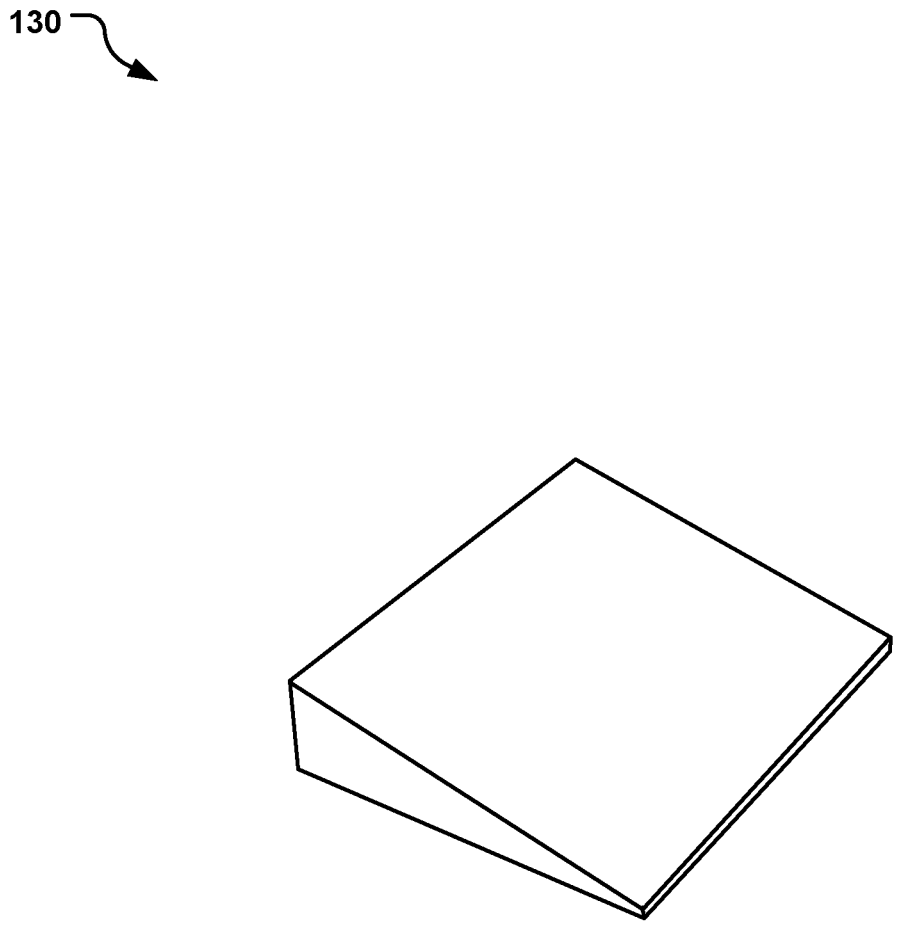
FIG. 4 is a perspective view of a support pillow of the pillow system of FIG. 1.

FIG. 4 shows the support pillow 130, which is one design that can be used to adjust the elevation of any portion of the user's body. In some implementations, the elevation of a pillow (e.g., the small head pillow 120, the side pillow(s) 110, or both) is adjusted with the support pillow 130. This particular support pillow 130 has a tapered shape, such as a wedge, that provides an incline to the user. The support pillow 130 may be placed, e.g., at the user's upper body (e.g., the head, shoulders) as shown in FIG. 1, or at the user's lower body, e.g., at the knees, or at the feet. In some implementations, the pillow system includes two support pillows; when two support pillows are used, the pillows may have the same or different shapes and/or dimensions. Pillow systems with two support pillows are show in FIGS. 5 and 6.

The pillow system 100 of FIG. 1 is shown in a first configuration, with the wedge-shaped support pillow 130 below and supporting the two elongate side pillows 110 on which is the head pillow 120. The wedge-shaped support pillow 130 could be moved either direction (e.g., toward or away from the second end 112 of the side pillows 110) to adjust the incline of the user's head and shoulders. The second end 112 of the side pillows 110, where the user's buttocks and legs are positioned, is fairly flat or level. The crease 140*a*, 140*b* seen in the side pillows 110*a*, 110*b*, respectively, is a temporary crease, unfolding itself when the support pillow 130 is removed and the side pillows 110 are leveled.

Figure 5:
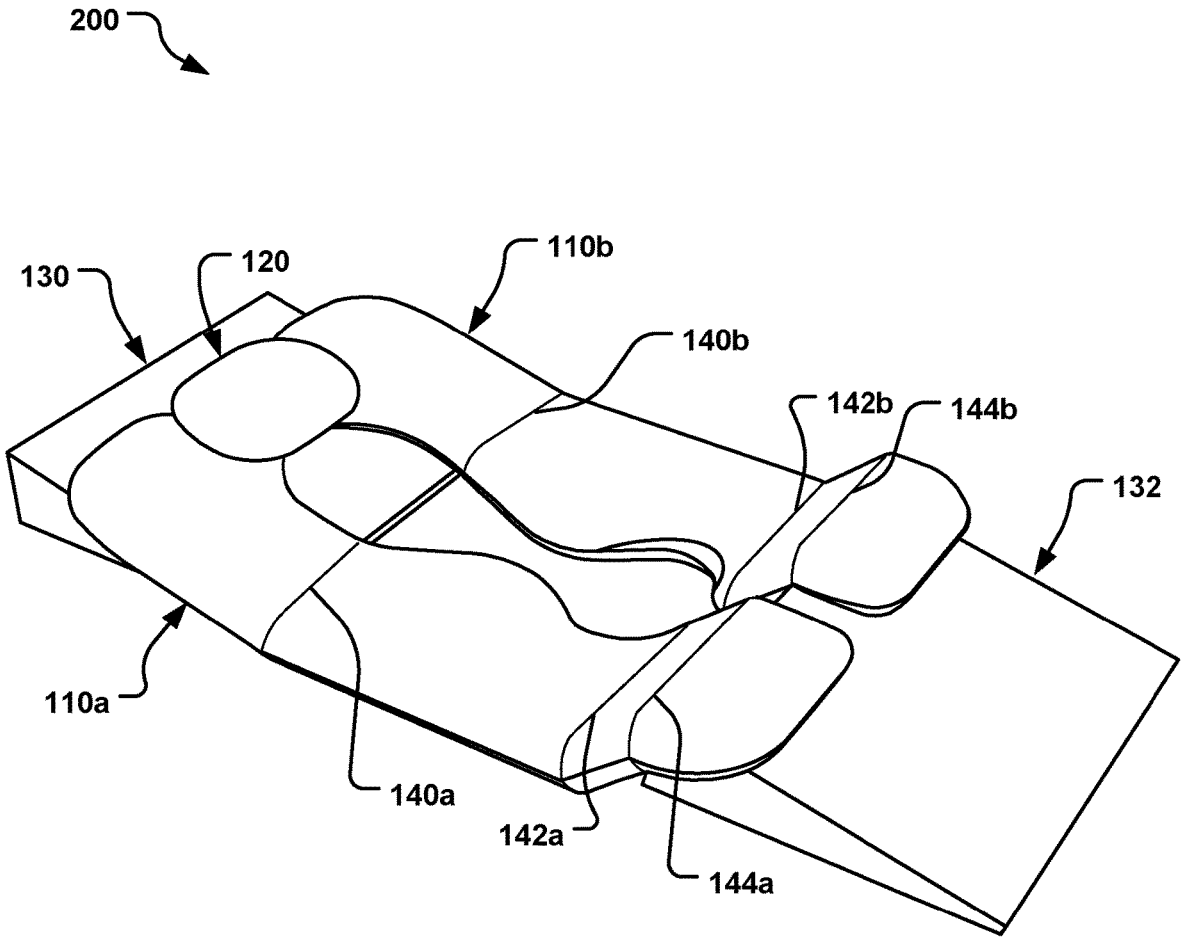
FIG. 5 is a perspective view of another pillow system.
Figure 6:
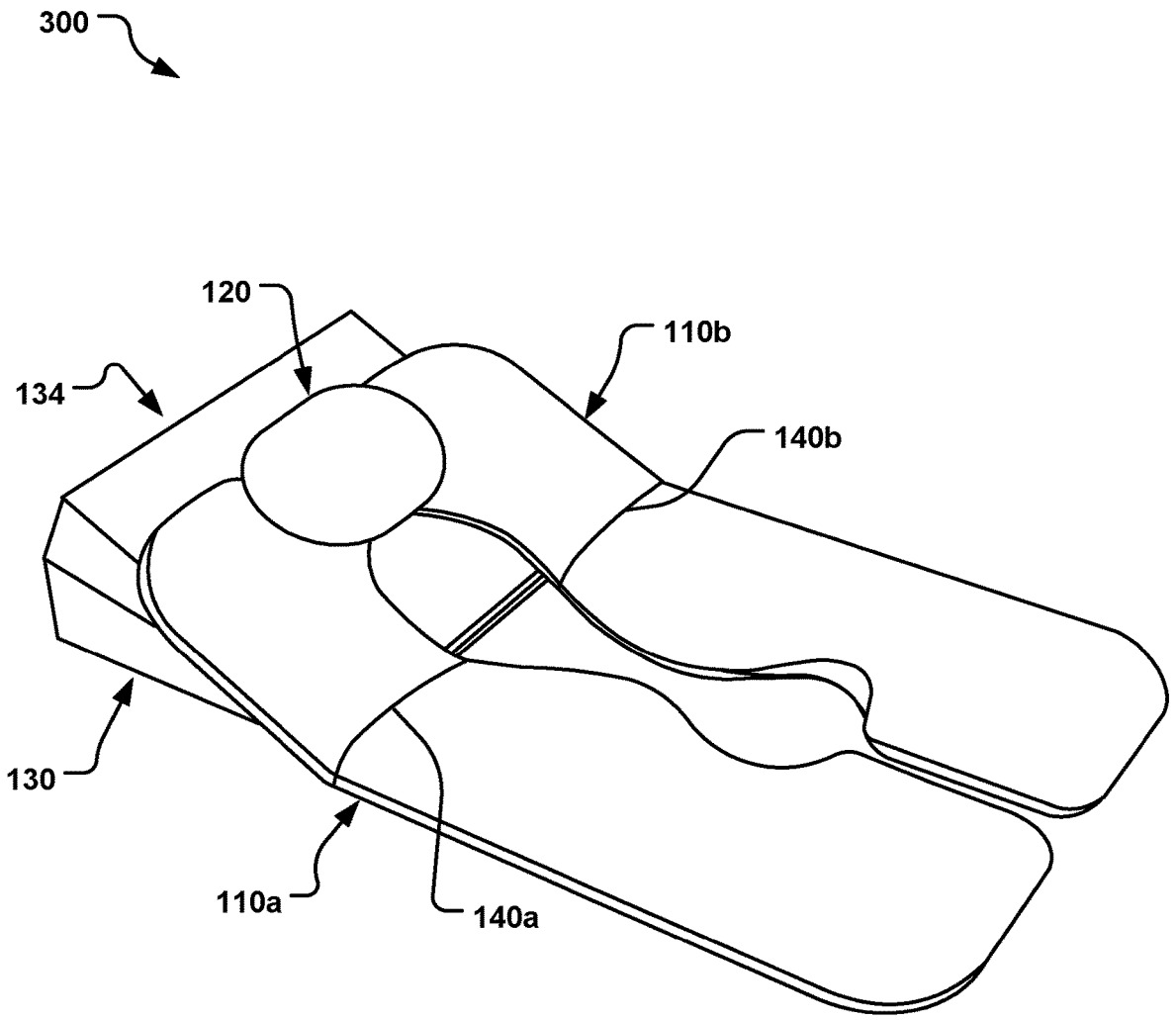
FIG. 6 is a perspective view of another pillow system.

As indicated above, FIGS. 5 and 6 show other configurations of pillow systems having two support pillows.

In FIG. 5, another wedge-shaped pillow 132 is added to the two side pillows 110, the head pillow 120 and the wedge-shaped pillow 130 to form a pillow system 200. This wedged-shaped pillow 132 may have the same size and shape as the wedge pillow 130, or it may differ. This pillow system 200 is formed of five pillows, with the second wedge-shaped pillow 132 positioned proximate the location where a user's knees would be positioned, when the pillow system 200 is in use. The side pillows 110 have creases 142*a*, 144*a* in the pillow 110*a* and creases 142*b*, 144*b* in the pillow 110*b* at a location proximate the user's buttocks, allowing the side pillows 110 to support the user's thigh and the knee, which would be positioned at the high point of the wedge-shaped pillow 132. The creases 142, 144 are temporary, unfolding themselves when the wedge-shaped pillow 132 is removed and the side pillows 110 are leveled.

In FIG. 6, another wedge-shaped pillow 134 is added to the side pillows 110, the head pillow 120 and the wedge-shaped pillow 130 to form a pillow system 300. This wedged-shaped pillow 134 may have the same size and shape as the wedge-shaped pillow 130, or it may differ. This wedge-shaped pillow 134 may be the same as or different than the other wedge-shaped pillow 132 of FIG. 5; that is, the pillow 134 may be a different pillow than the pillow 132 or the pillows 132, 134 may be the same pillow, merely situated differently. This modified system 300 is formed of five pillows, with the pillow 134 stacked on the pillow 130, to provide the user's head, neck, back, or shoulders with additional elevation and incline.

Other shapes and sizes of support pillows may be used in addition to or in place of the support pillows 132, 134 shown here.

The pillows of the pillow systems 100, 200, 300 and variations thereof provide cushioning while supporting the user while laying on their back. One, any, or all of the pillows of the pillow systems can be used in conjunction with each other to provide a customizable support system. For example, FIG. 1 shows the pillow system 100 configured to elevate the user's head, back, and shoulders, FIG. 5 shows the pillow system 200 configured to elevate the user's head, back, shoulders and knees, and FIG. 6 shows another pillow system 300 configured to elevate the user's head, back, and shoulders even more than the pillow system 100.

In one specific implementation, the elongate side pillows 110 have a length, from the first end 111 to the second end 112 of at least 3 feet and typically no more than 6 feet, for example, a length in a range of 4 feet to 6 feet. Example lengths include 4 feet, 4 feet 6 inches, 5 feet, and 5 feet 6 inches. The widest point between the inner edge 113 and the outer edge 114 is at least 6 inches and no more than 2 feet, typically no more than 16 inches. The narrowest point in the width of the pillows 110, between the inner edge 113 and the outer edge 114, is at one or both of the first concave region 115 and the second concave region 116. The side pillows 110 have a maximum thickness of 2 to 10 inches. In one specific example, the thickest part of the side pillow 110 is proximate the second end 112, and the thinnest part of the side pillow 110 is proximate the first end 111.

The concave regions 115, 116 may have the same depth (or, distance from the edge of the concave region 115, 116 to the outer edge 114) or may have different depths. Either region 115, 116 may be deeper. In the implementation illustrated in FIG. 2, the first concave region 115 is deeper than the second concave region 116, so that the first void area 117 has a greater width, measured laterally across the system 100, than the second void area 118. For example, the concave regions 115, 116 may have a depth of at least 2 inches and no more than 6 inches. The length of the concave regions 115, 116 (measured longitudinally extending in the direction between the first end 111 and the second end 112) can be, e.g., between 6 inches and 2 feet. The first concave region 115 is spaced from the first end 111 at least 9 inches, and no more than 12 inches, and is at least 2 inches deep. The second concave region 116 is spaced from the second end 112 at least 11 inches, and no more than 16 inches, and is at least 1 inch deep. This distance between the first concave region 115 and the second concave region 116 is at least 4 inches and no more than 9 inches.

The head pillow 120 can have any cross-sectional shape, although is most commonly rectangular or oval, optionally having rounded or radiused corners. The pillow 120 may be, e.g., 6 inches to 16 inches in one dimension (e.g., from the first edge 121 to the second edge 122), 12 inches to 20 inches in the other dimension (e.g., from the first end 123 to the second end 124), and up to about 6 inches thick.

The shown wedge-shaped support pillow 130 has a maximum height of no more than 8 inches, often no more than 7 inches. The width of the support pillow 130, in the direction of the width of the side pillows 110, can be similar to the width of two side pillows 110, when arranged in a "use" position, or narrower than the two side pillows 110, or more than the two side pillows 110. For example, the width of the support pillow 130 is, e.g., 1 foot to 2 feet 6 inches. The length of the support pillow 130, in the direction of the length of the side pillows 110 when arranged in a "use" position as in FIG. 1, is 1 foot to 3 feet, e.g., 2 feet. The angle of incline of any wedge-shaped pillow will be determined by the maximum height and the length of the wedge-shaped pillow.

Any combination of the pillows 110, 120, 130, 132, 134 can be used to provide a pillow support system particularly adapted for a user's resting or laying on their back.

Any or all of the pillows 110, 120, 130, 132, 134, and variations thereof, may be formed of a continuous stuffing material having an essentially solid nature, e.g., foam (open cell, closed cell, polyurethane, polyester, olefin), nonwoven or felted fibers, rubber, natural sponge, or of a non-continuous particulate material, such as foam pieces, down/feathers, synthetic down/feathers, polystyrene beads, polyester beads, etc., or of a lofty (e.g., fluffy) material, such as polyester fiber. It is not necessary that every pillow be formed with the same stuffing material; for example, the side pillows 110 may be formed of a lofty insulation (e.g., polyester fiber fill), which fairly flexible and conformable, whereas the head pillow 120 is formed from a lofty insulation (e.g., polyester fiber fill), and the wedge-shaped support pillow 130 is formed from a high durometer foam, either open cell or closed cell. In another example, the head pillow 120 can be formed from a "memory foam." Some users may prefer a softer head pillow than the side support pillows. The support pillows (either wedge-shaped or other shape) are generally less compressible than the side pillows 110 and the head support pillow 120. The side pillows 110 may be sufficiently flexible to allow easy folding and bending of the pillows 110.

The pillows may have a slipcover or pillowcase thereon, which is readily removable, e.g., for laundering, from the pillow. FIGS. 7 through 9 and FIG. 10B provide sample patterns for covers or pillowcases for the various pillows of the pillow system 100. Some of the slipcovers or pillowcases are designed with zippers to allow access to the interior of the cover, to allow for inserting and removal of the pillow; other attachment mechanisms, other than a zipper, can be used.

Figure 7:
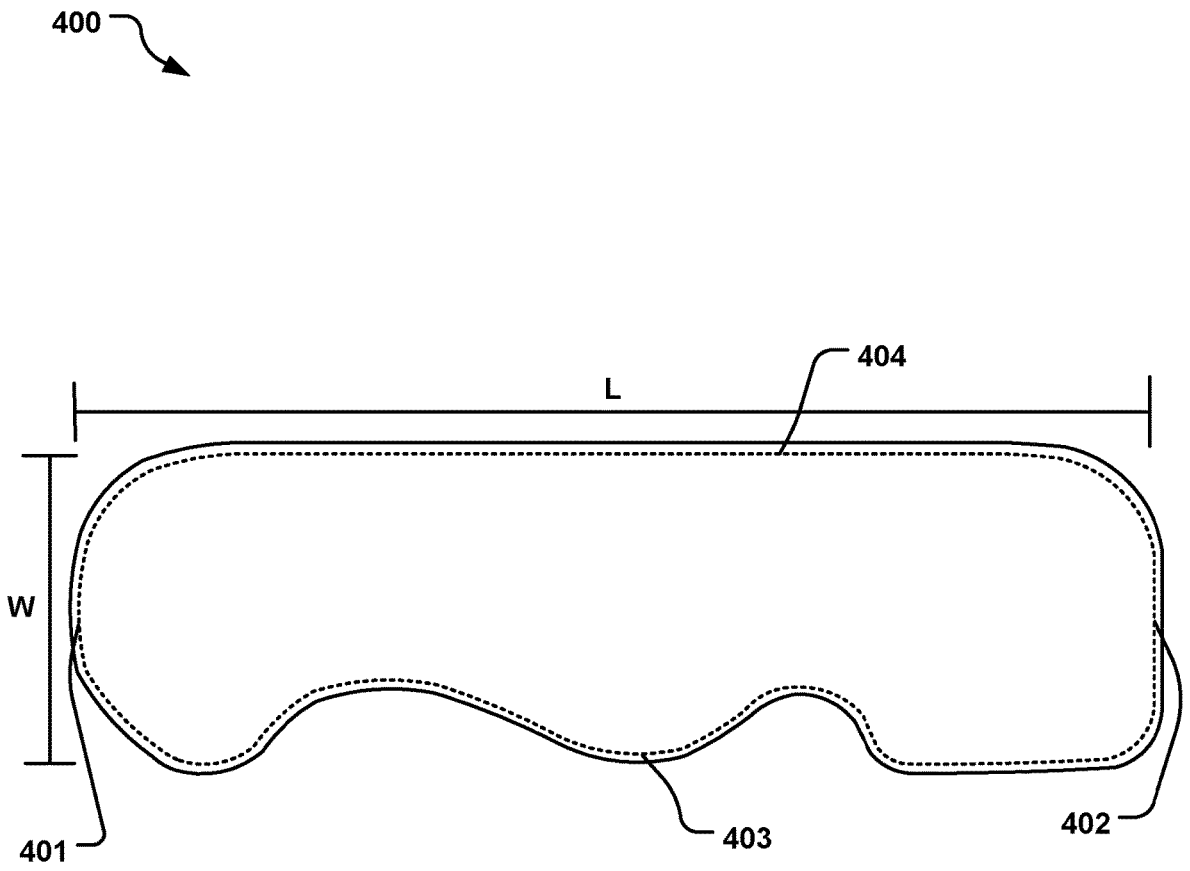
FIG. 7 is a plan view of one side panel that forms a pillowcase or cover for a side pillow.

FIG. 7 shows a plan view of a pattern 400 for a cover (pillowcase, slipcover) for a side support pillow, such as the pillows 110 of FIGS. 1 and 2. The cover would be made from flexible material, such as fabric (e.g., woven, knitted, nonwoven, felted), leather, vinyl, or other similar material. The fabric may be made from, e.g., cotton, polyester, nylon, acetate, rayon, silk, wool, and any combinations thereof.

The pattern 400 has a first end 401 which corresponds to the first end 111 of the pillow 110, a second end 402 that correspondence to the second end 112 of the pillow 110, an arcuate edge 403 and a straight edge 404, which correspond to the inner edge 113 and the outer edge 114, respectively, of the pillow 110.

Shown on the pattern 400 is stitching, where two pieces of the pattern 400 (or other pattern) are attached together (e.g., by sewing). The measurements provided below for the pattern 400 and all other patterns do not include the material (e.g., fabric) between the seam formed by the shown stitching and the edge of the material; rather, the dimensions provided are based on the position of the stitching.

The pattern 400 has a length L from the first end 401 to the second end 402. The length L is in the range of 4 feet to 6 feet, e.g., 5 feet, or, e.g., 4 feet 8 inches, or, e.g., 5 feet 6 inches. The pattern 400 also has a width W from the arcuate edge 403 to the straight edge 404; the width W of the pattern 400 is based on the position of the stitching. At its maximum point, the width W is in the range of 1 foot to 2 feet, e.g., 18 inches or 1 foot 6 inches, or, e.g., 16 inches. In the shown design, the width W is the same at the first end 401 and the second end 402.

The material of the pattern 400 can include a high-friction or no-slip surface anywhere along the length or width of the eventual side pillow; such would stabilize the pillow when incorporated into a pillow system, as shown in FIG. 1.

Figure 8:
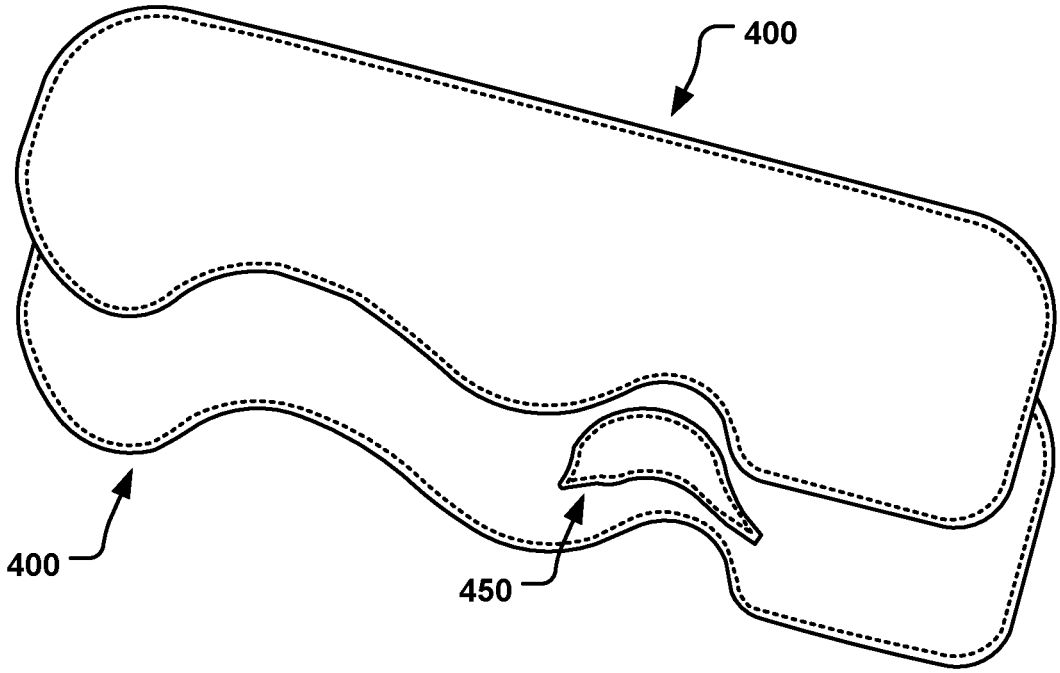
FIG. 8 is a perspective view of two side panels and an insert that together form the pillowcase or cover for the side pillow.

The pattern 400 of FIG. 7 is for the cover on one side or surface of a side pillow 110. FIG. 8 shows how two patterns 400 combine, together with an insert 450, to provide a cover for an entire elongate side pillow 110. The insert 450, in this design, accommodates the second concave region 116.

Figure 9:
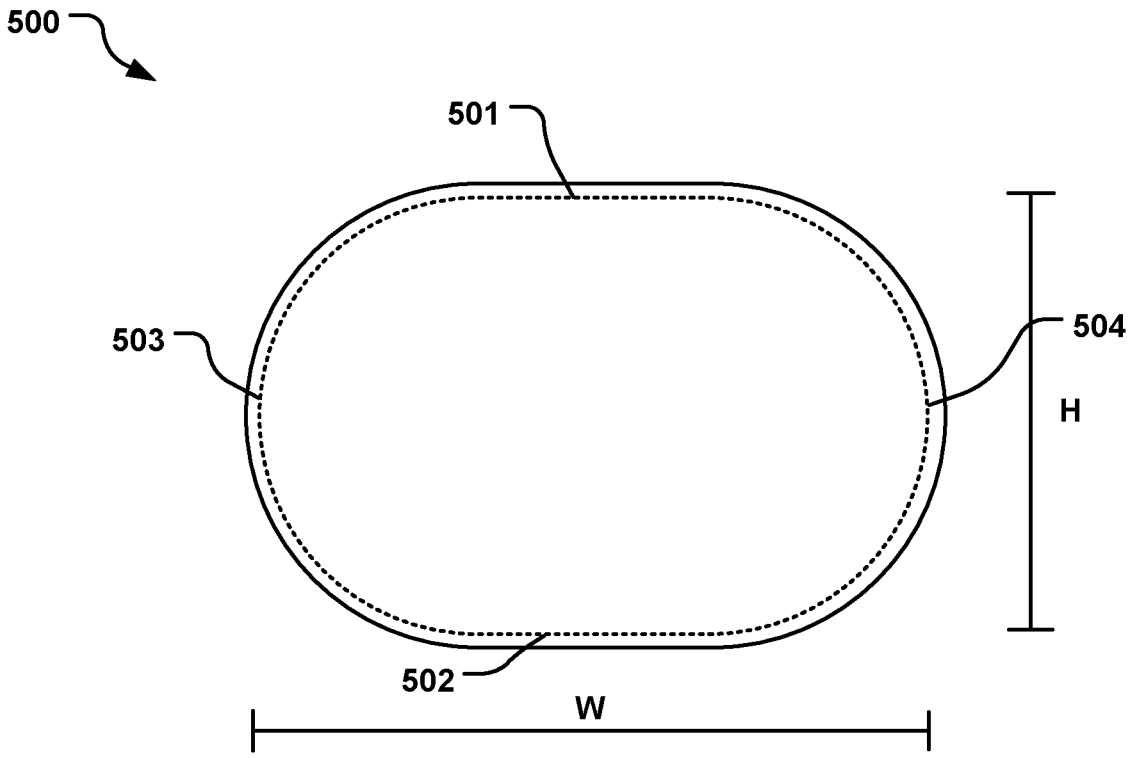
FIG. 9 is a plan view of one side panel that forms a pillowcase or cover for a head support pillow.

FIG. 9 shows a plan view of a pattern 500 for a cover (pillowcase, slipcover) for a head support pillow, such as the pillow 120 of FIGS. 1 and 2. The cover would be made from flexible material, such as fabric (e.g., woven, knitted, nonwoven, felted), leather, vinyl, or other similar material. The fabric may be made from, e.g., cotton, polyester, nylon, acetate, silk, wool, and any combinations thereof. The pattern 500 has a first edge 501 which corresponds to the first edge 121 of the pillow 120, a second edge 502 that correspond to the second edge 122 of the pillow 120, a first end 503 and second end 504, which correspond to the first end 123 to the second end 124, respectively, of the pillow 120. On the cover may be one or more areas that include a high-friction or no-slip surface on one side; this stabilizes the pillow when on the side pillows 110, as shown in FIG. 1. The side pillow covers may have a corresponding high-friction or no-slip area.

The pattern 500 has a height H from the first edge 501 to the second edge 502 in the range of 6 inches to 16 inches, e.g., 11 inches, or, e.g., 12 inches. The pattern 500 also has a width W from the first end 503 to the second end 504 in the range of 12 inches to 20 inches, e.g., 16 inches, or, e.g., 18 inches. Of course, as indicated above, the head pillow 120 can have other shapes and sizes than shown in this disclosure; it is understood that the cover could match or accommodate the head pillow, no matter the shape and size.

Figure 10A:
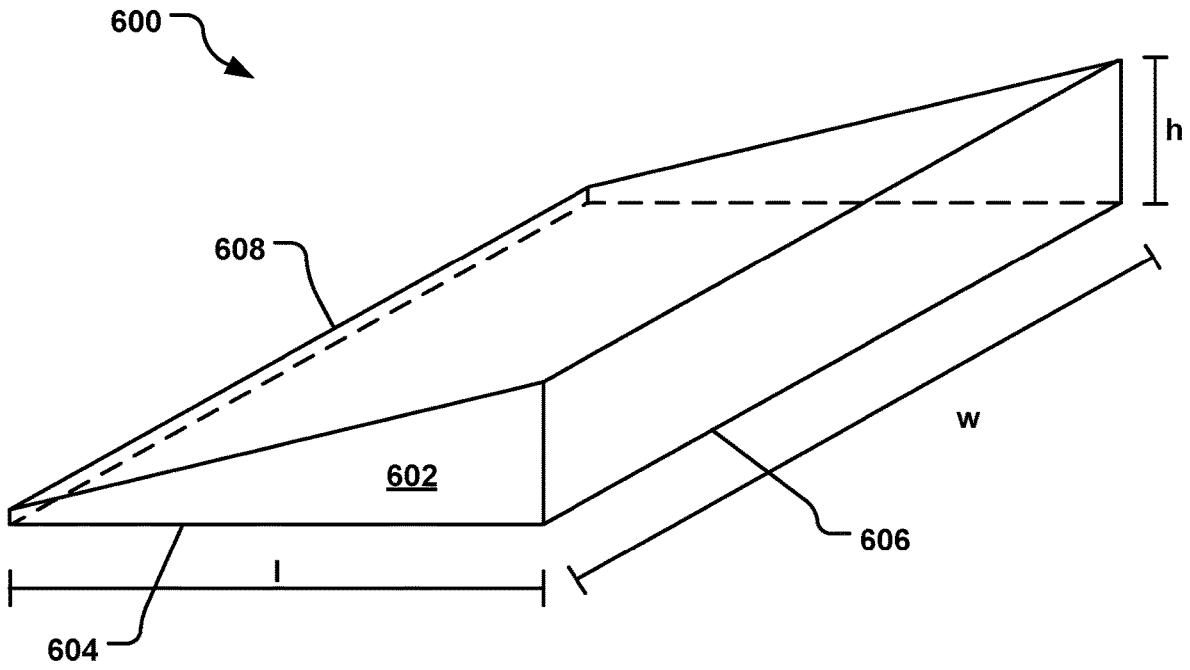
FIG. 10A is a perspective view of a wedge-shaped support pillow.

FIG. 10A shows a wedge-shaped support pillow 600, such as the support pillow 130, support pillow 132 and/or support pillow 134. This pillow 600 has two identical side panels 602, a base 604, a back 606, and a sloped surface 608. The pillow 600 has a right angle corner between the base 604 and the back 606, thus the sloped surface 608 is the hypotenuse.

The pillow 600 has a width w of the back 606, in the lateral direction of the width of the side pillows 110, in the range of 2 feet to 3 feet, e.g., 2 feet 6 inches, which can be similar to, less than, or more than the width of two side pillows 110, when arranged in a "use" position. The pillow 600 has a height h, which is the height of the back 606, in the range of less than 1 inch (e.g., ½ inch, or ¾ inch) to 12 inches, e.g., 4 inches, or e.g., 6 inches. Further, the pillow 600 has a length l, in the range of 1 foot to 3 feet, e.g., 2 feet.

Figure 10B:
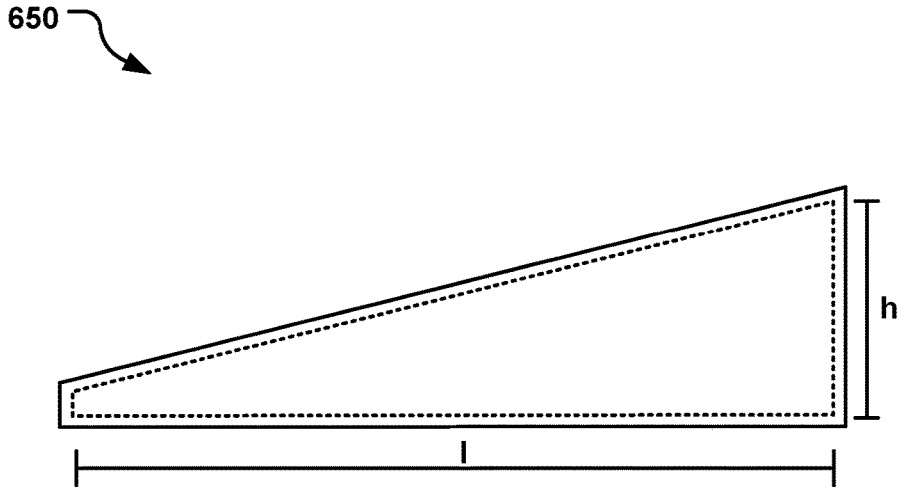
FIG. 10B is a plan view of a side panel that forms a pillowcase or cover for a wedge-shaped support pillow.

FIG. 10B shows a plan view of a partial pattern 650 for a cover (pillowcase, slipcover) for the pillow 600 of FIG. 10A, particularly for one of the side panels 602. The pattern 650 has a height h (based on the position of the stitching) the same as the height h of the back 606 of the pillow 600, and the pattern 650 has a length l (based on the position of the stitching) the same as the length l of the side panel 602.

To form a pillowcase or cover for the pillow 600 of FIG. 10A, two side panel patterns 650 are combined with rectangular pieces: one to cover the base 604, one to cover the back 606, and one to cover the slope surface 608. Depending on the angle of the pointed edge of the pillow 600, a separate piece may or may not be used for that edge. One with ordinary skill in the field of sewing can produce a complete pillowcase or cover for the pillow 600 based on the details provided herein. The pillowcase or cover would be made from flexible material, such as fabric (e.g., woven, knitted, nonwoven, felted), leather, vinyl, or other similar material. The fabric may be made from, e.g., cotton, polyester, nylon, acetate, silk, wool, and any combinations thereof.

Any of the pillows may have a single cover or two covers. For example, any pillow may have an inner or protective cover (e.g., made of polyester material) and an outer cover (e.g., made of cotton material). Either cover or at least the outer cover can have decorative indica or a pattern thereon for aesthetic purposes. Either or both covers can be removable from and replaceable on the pillow, e.g., for washing of the cover(s).

As seen throughout the figures, the individual pillows are combined to form a pillow system that cradles the user and provides a comfortable sleep experience, particularly for a user laying on their back, e.g., after a mastectomy. The individual pillows may be connected together, either permanently or temporarily (e.g., releasably and re-engageably), to obtain the overall pillow system ready to receive a user. A permanent connection may be, e.g., stitching, staples, adhesive, rivets or darts, etc., whereas a temporary connection may be, e.g., hook-and-loop or other mating fasteners, zipper(s), snaps, adhesive, wrapped with sheet(s), or merely friction between the pillow coverings. A permanent connection may be adjustable; for example, a cloth, tape, or ribbon may connect two pillows (e.g., two side pillows) but their spacing is adjustable, due to the flexible nature of the connection. In some designs, the two side pillows may be formed as one pillow.

Any of the overlapping areas of the pillows, e.g., where the side pillows rest on a wedge support pillow, or where the head support pillow rests on the side pillows, may have anti-slip or high friction material on the cover(s).

By utilizing multiple individual pillows, the system can be configured to the best arrangement for each user. For example, a larger (e.g., wider) user may desire to have a larger distance between the side pillows than a smaller user. A user with a shorter torso may desire to have the distance between a head support pillow and a knee support pillow less than the distance desired by a user with a longer torso.

Figure 11:
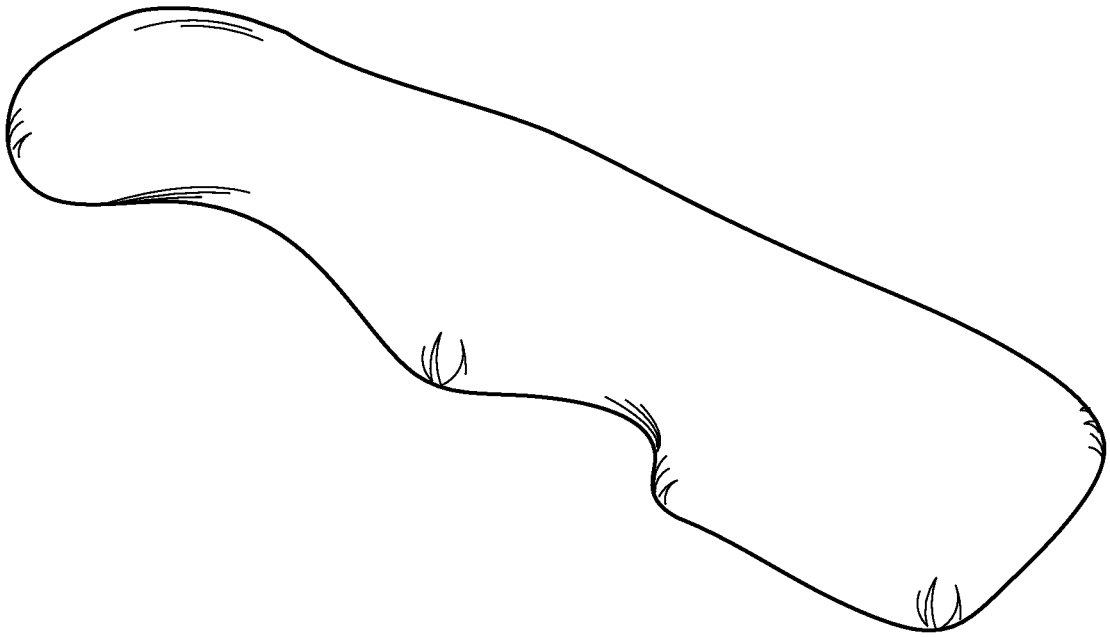
FIG. 11 is a perspective view of another elongate side pillow.
Figure 12:
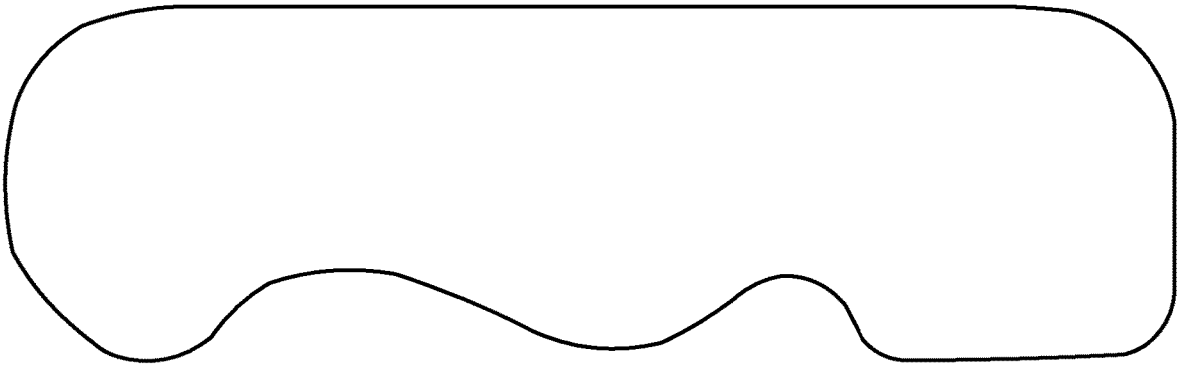
FIG. 12 is a top plan view of the pillow of FIG. 11.
Figure 13:
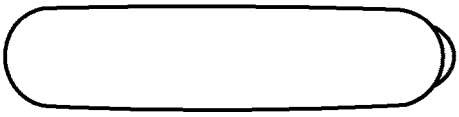
FIG. 13 is a back elevation view of the pillow of FIG. 11.
Figure 14:
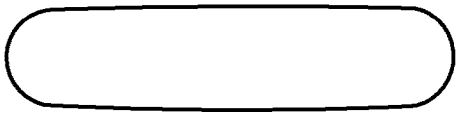
FIG. 14 is a front elevation view of the pillow of FIG. 11.
Figure 15:
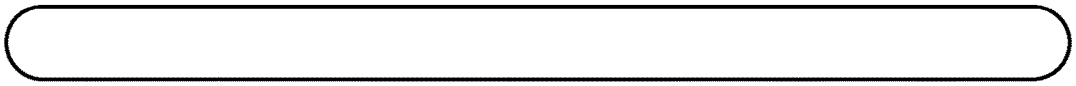
FIG. 15 is a right side view of the pillow of FIG. 11.
Figure 16:
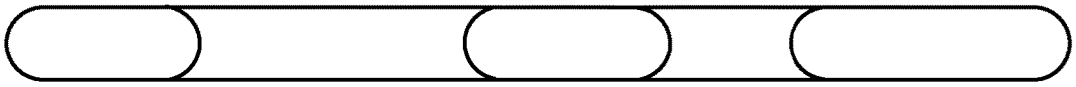
FIG. 16 is a left side view of the pillow of FIG. 11.
Figure 17:
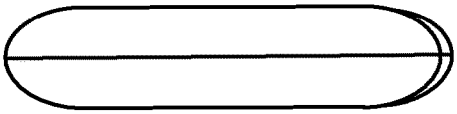
FIG. 17 is a back elevation view of a pillow, similar to that of FIG. 11, FIG. 17 showing a seam in a pillowcase or cover on the pillow.
Figure 18:
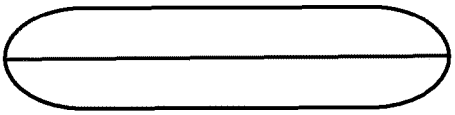
FIG. 18 is a front elevation view of the pillow, similar to that of FIG. 11, FIG. 18 showing a seam in the pillowcase or cover on the pillow.
Figure 19:
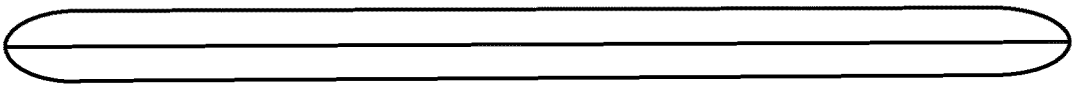
FIG. 19 is a right side view of the pillow, similar to that of FIG. 11, FIG. 19 showing a seam in the pillowcase or cover on the pillow.
Figure 20:
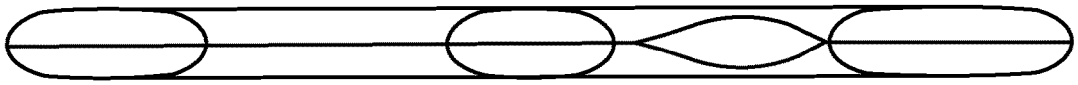
FIG. 20 is a left side view of the pillow, similar to that of FIG. 11, FIG. 20 showing a seam in the pillowcase or cover on the pillow.

A particular implementation of a single side pillow is shown in FIGS. 11 through 16, where FIG. 11 is a front-left side-top perspective view, FIG. 12 is a top plan view of the pillow, with the bottom plan view being a mirror image, FIG. 13 is a back plan view (e.g., of the second end 112), FIG. 14 is a front plan view (e.g., of the first end 111), FIG. 15 is a right side elevation view (e.g., of the outer edge 114), and FIG. 16 is a left side elevation view (e.g., of the arcuate inner edge 113) of the pillow.

To use the pillow system 100, referring to FIG. 1, two side pillows 110 are positioned parallel or essentially parallel to each other. One of the ends, either the first end 111 or the second end 112, is positioned to receive the user's head and shoulders, and the other end is positioned to receive the user's legs. To form the configuration of FIG. 1, the wedge-shaped support pillow 130 is positioned under the pillows 110 at the end (either the end 111 or the end 112) to raise the user's head and shoulders and the head support pillow 120 is positioned at the other end. The pillow system 100 may be placed, e.g., on the floor or on an elevated surface, such as a bed or couch.

To use the pillow system 100, the user would simply climb onto the pillows 110 and position their head and shoulders at the one end and their legs and feet at the other end. The side support pillows 110 and the head support pillow 120 can be readily adjusted for a comfortable position. The wedge-shaped support pillow 130 may also be adjusted, if needed. When done, the user climbs or rolls off of the pillow system 100. For some users, folding one of the side pillows 110 up towards the head end may facilitate disembarking from the pillow system 100.

The pillow system 200 would be similarly used, however, including the second wedge-shaped pillow at the knees to raise the user's knees. The pillow system 300 would also be similarly used, however including the second wedge-shaped pillow stacked on top of (or below) the primary wedge-shaped pillow.

The above specification and examples provide a complete description of the structure and use of exemplary implementations of the invention. The above description provides specific implementations. It is to be understood that other implementations are contemplated and may be made without departing from the scope or spirit of the present disclosure. The above detailed description, therefore, is not to be taken in a limiting sense. While the present disclosure is not so limited, an appreciation of various aspects of the disclosure will be gained through a discussion of the examples provided.

Unless otherwise indicated, all numbers expressing feature sizes, amounts, and physical properties are to be understood as being modified by the term "about," whether or not the term "about" is immediately present. Accordingly, unless indicated to the contrary, the numerical parameters set forth are approximations that can vary depending upon the desired properties sought to be obtained by those skilled in the art utilizing the teachings disclosed herein.

As used herein, the singular forms "a", "an", and "the" encompass implementations having plural referents, unless the content clearly dictates otherwise. As used in this specification and the appended claims, the term "or" is generally employed in its sense including "and/or" unless the content clearly dictates otherwise.

Spatially related terms, including but not limited to, "bottom," "lower", "top", "upper", "beneath", "below", "above", "on top", "on," etc., if used herein, are utilized for ease of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above or over those other elements.

What is claimed is:

1. A pillow system for supporting a user while laying on their back, the system comprising: a first elongate side support pillow and a second elongate side support pillow, the first side pillow unconnected to the second side pillow, each side pillow having a length from a first end to a second end greater than a width from an arcuate inner edge to an outer edge, the entire outer edge is straight with the exception of radius portions proximate the first end and the second end, the arcuate inner edge defining a first concave region and a second concave region extending toward the outer edge to reduce the width at the concave regions, the first concave region spaced from and closer to the first end than to the second end, and the second concave region spaced from and closer to the second end than to the first end, each side pillow having a length of at least 4 feet, a maximum width of 6 inches to 24 inches, and a thickness of 2 inches to 12 inches.

2. The pillow system of claim 1, wherein the elongate side support pillows are mirror images of each other.

3. The pillow system of claim 1 further comprising a head pillow.

4. The pillow system of claim 1 further comprising a wedge support pillow.

5. The pillow system of claim 1, wherein the first concave region and the second concave region in each side pillow is independently at least 2 inches deep and no more than 6 inches deep.

6. The pillow system of claim 1, wherein the first concave region and the second concave region are arcuate.

7. The pillow system of claim 1, wherein the first concave region and the second concave region are not the same.

8. The pillow system of claim 7, wherein the first concave region and the second concave region differ by their depth.

9. The pillow system of claim 7, wherein the first concave region and the second concave region differ by their length.

10. The pillow system of claim 1, wherein each of the elongate side support pillows has a length of 56 to 65 inches and a width of 10 to 18 inches.

11. A pillow system for supporting a user while laying on their back, the system comprising at least three individual pillows: a pair of elongate side support pillows, each side pillow having a length from a first end to a second end greater than a width from an inner edge to an outer edge, the entire outer edge of each of the elongate side support pillows is straight with the exception of radius portions proximate the first end and the second end, the inner edge defining a first concave region and a second concave region extending toward the outer edge to reduce the width at the concave regions, together the first concave regions defining a first void area and the second concave regions defining a second void area; and a head support pillow.

12. The pillow system of claim 11 further comprising a wedge-shaped support pillow.

13. The pillow system of claim 12 further comprising a second wedge-shaped support pillow.

14. The pillow system of claim 11, wherein the elongate side support pillows are mirror images of each other.

15. The pillow system of claim 11, wherein the length of each of the elongate side support pillows is at least 4 feet and the width of each is 6 inches to 24 inches.

16. The pillow system of claim 15, wherein the length of each of the elongate side support pillows is 56 to 65 inches and the width of each is 10 to 18 inches.

* * * * *